United States Patent [19]

Schwartz

[11] Patent Number: 4,579,359

[45] Date of Patent: Apr. 1, 1986

[54] BABY WALKER WITH SAFETY BRAKE

[75] Inventor: Leo Schwartz, Montreal, Canada

[73] Assignee: Dorel Co. Ltd., Quebec, Canada

[21] Appl. No.: 635,272

[22] Filed: Jul. 27, 1984

[51] Int. Cl.[4] ..... B62B 9/12

[52] U.S. Cl. ..... 280/87.02 W; 297/6

[58] Field of Search ..... 280/43.24, 87.02 W, 280/302; 188/5, 6; 297/5, 6

[56] References Cited

U.S. PATENT DOCUMENTS

| | | | |
|---|---|---|---|
| 2,537,909 | 1/1951 | Puddester | 188/5 |
| 3,217,839 | 11/1965 | Watkins | 280/302 |
| 4,359,242 | 11/1982 | Gerken | 280/87.02 W |

*Primary Examiner*—David M. Mitchell

*Assistant Examiner*—Richard M. Camby

*Attorney, Agent, or Firm*—Oblon, Fisher, Spivak, McClelland & Maier

[57] ABSTRACT

A safety brake for a self-propelled child vehicle, such as a baby walker. The vehicle has a frame supported on wheels and the safety brake is constituted by a support rod pivotally secured at opposed connecting ends thereof to the frame and defining a vehicle support section and a bridge section between the support section and the connecting ends. The support rod is displaceable from a disengaged position, where the vehicle is freely displaceable on its wheels on a surface, to an engaged position, where the support section rests on the surface with at least some of the wheels lifted above the surface whereby to arrest the vehicle.

8 Claims, 3 Drawing Figures

BABY WALKER WITH SAFETY BRAKE

BACKGROUND OF INVENTION (a) Field of the Invention

The present invention relates to a self-propelled child vehicle, such as a baby walker, and particularly, to a safety brake secured thereto whereby to prevent the vehicle from being displaced by a child seated therein.

(b) Description of Prior Art

In order to train babies to walk, there has been provided a self-propelled vehicle commonly known as a baby walker. Such vehicles are constituted by an annular frame supported on wheels and having connected thereabove a seat section, which is usually adjustable in height, whereby to accommodate a child with its legs protruding in the inner area of the annular frame whereby his feet touch the floor surface whereby to displace the vehicle by the movement of the child's feet. The disadvantage of such vehicle is that when they are left unattended, the child may displace himself to a dangerous area, such as a balcony or a stair-well and not being aware of the danger the vehicle may be propelled over the balcony or down the stair-well. There is therefore a need to provide a safety device which can arrest the vehicle from displacement by the child when it is necessary to leave a child seated thereon, unattended.

SUMMARY OF INVENTION

It is a feature of the present invention to provide a safety brake for use on a self-propelled vehicle, such as a baby walker, whereby to prevent the vehicle from being displaced.

It is a further feature of the present invention to provide a safety brake for a self-propelled vehicle, such as a baby walker, and wherein the safety brake, when in its disengaged position, is supported in a nonobstructing manner to a child seated on the vehicle.

Another feature of the present invention is to provide a safety brake for a self-propelled vehicle, such as a baby walker, and wherein the safety brake is easy to engage and disengage and is reliable to arrest the vehicle.

According to the above features, from a broad aspect, the present invention provides a safety brake for a self-propelled child vehicle, such as a baby walker. The vehicle has a frame supported on wheels and the safety brake is constituted by a support rod pivotally secured at opposed connecting ends thereof to the frame and defining a vehicle support section and a bridge section between the support section and the connecting ends. The support rod is displaceable from a disengaged position, where the vehicle is freely displaceable on its wheels on a surface, to an engaged position, where the support section rests on the surface with at least some of the wheels lifted above the surface whereby to arrest the vehicle.

BRIEF DESCRIPTION OF DRAWINGS

A preferred embodiment of the present invention will now be described with reference to the example thereof as illustrated in the accompanying drawings, in which.

DESCRIPTION OF PREFERRED EMBODIMENTS

Figure 1:
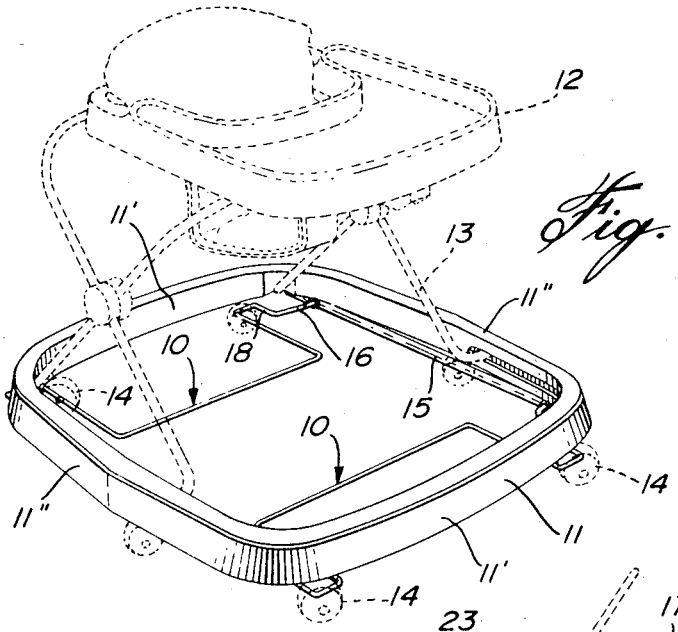
FIG. 1 is a perspective view of a self-propelled vehicle, such as a baby walker, illustrating the support frame thereof with a pair of safety brakes of the present invention shown in the engaged position thereto.

Referring now to the drawings, there is shown generally at 10 the safety brake of the present invention which is connected to a frame 11 of a self-propelled vehicle, such as a baby walker, and having supported above the frame a seat section 12 which is vertically adjustable on an adjustable support frame 13 which is connected at its lower end to the vehicle frame 11. At least a pair of wheels 14 is secured under the frame 11 at each end thereof. As herein shown, the frame 11 is of substantially rectangular configuration defining front and rear arms 11' and side arms 11''. The frame 11 is also constructed as a moulded plastic piece.

A structural metal bar 15 is secured under each side arms 11'' of the frame 11 and extends substantially parallel to one another. Each safety brake 10 is constituted by a formed metal support rod pivotally secured at opposed connecting ends 16 to the structural bars 15 and extends substantially transverse thereacross. Of course, these support rods may be secured directly into the side arms 11'' of the frame 11 or otherwise secured to the frame but in this preferred example, structural bars 15 are provided whereby to effect this securement.

Figure 2:
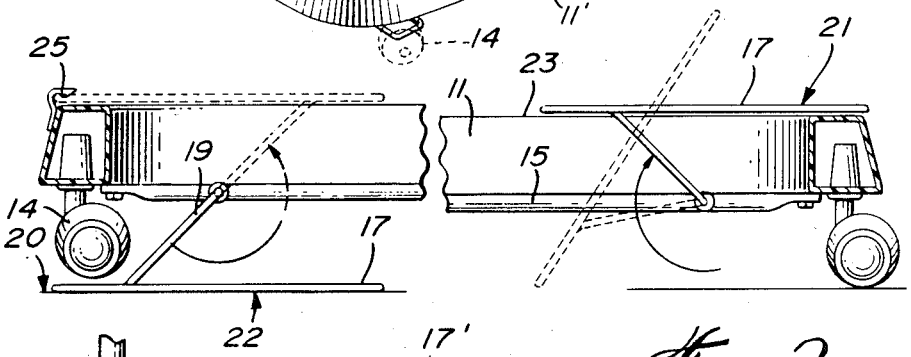
FIG. 2 is a fragmented section view showing the connection and operation of the safety brake of the present invention where one brake is engaged and the other disengaged.
Figure 3:
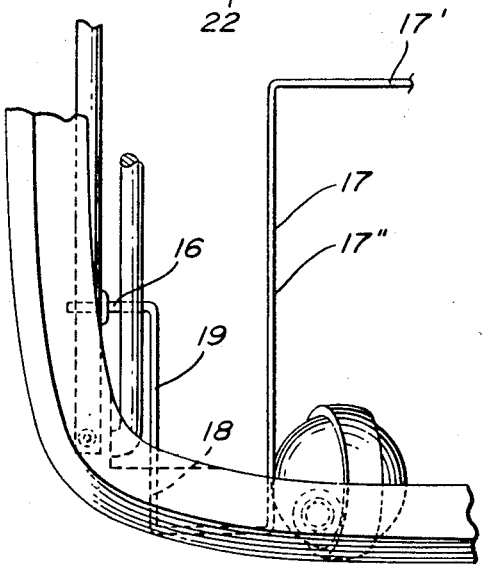
FIG. 3 is a fragmented top view of a corner of the frame showing the connection of the safety brake thereto.

The support rod is shaped to define a large U-shaped vehicle support section 17 constituted by a straight bridge rod section 17' and opposed straight transverse side sections 17'', all of which are disposed in a common plane as clearly shown in FIG. 2. A small inverted U-shaped section 18 is formed integral at the free end of the opposed side sections 17'' for added rigidity. The opposed connecting ends 16 are integrally formed in the outer side arm of the small inverted U-shaped section 18 and defines a bridge section 19 which is angulated upwardly from the plane of the support section 17 and is of sufficient length whereby to support its associated adjacent pair of wheels 14 elevated from a surface 20 when said safety brake is positioned in its engaged position.

Referring now to FIG. 2, there is shown a preferred embodiment wherein there is provided two of such safety brakes 10, secured respectively adjacent the front and rear ends of the frame 11. At the right side of FIG. 2, the safety brake is shown in its disengaged position as illustrated at 21. In this position, the large U-shaped section of the safety brake lies closely spaced to the front and rear portions, respectively of the frame not to obstruct the inner area of the frame whereby to permit unobstructed displacement of the legs of an infant seated on the seat section 12 whereby to permit him to displace the self-propelled vehicle over a support surface. The safety brake is held in this disengaged position by suitable retention means which may be constituted by several mechanisms well known to a person skilled in the art. In the present example, the retention means is constituted by frictional engagement of the connecting ends 16 within the structural bar 15 whereby the bar is held in its disengaged position 21 by frictional retention.

By swinging the bar inwardly and downward and lifting one of the ends 11' of the frame 11, the vehicle support section 17 of the bar is disposed substantially parallel to the frame 11 whereby to assume its engaged position as shown at 22 in FIG. 2 with the support section 17 lying flat on the support surface 20. In this position, the wheels 14 adjacent the brake are lifted from the support surface 20 thereby preventing a child from displacing the vehicle. It is only necessary to provide one of these brakes adjacent one pair of wheels 14 to prevent the vehicle from being displaced. However, in the preferred embodiment described herein, there is provided a safety brake 10 adjacent each pair of wheels to prevent any movements of the frame whatsoever. Also, as shown in the drawings, the vehicle support section 17 is fairly large whereby to provide for a large support surface in engagement with the floor surface 20 and the small U-shaped sections 18 extend to the side of the wheels 14 whereby to ensure proper rigidity and support.

It is within the ambit of the present invention to cover any obvious modifications thereof, provided such modifications fall within the scope of the appended claims. For example, the retention means may be provided by a spring clip 25 located on the end frame sections, as shown in FIG. 2. Also, as previously described the connecting ends of the safety brakes 10 may be secured directly into the frame 11 rather than securing a structural bar 15 thereunder. Still further, the safety brake of the present invention may be installed on different types of self-propelled child vehicles whereby to arrest the movement of same.

I claim:

1. A safety brake for a self-propelled baby walker vehicle, said vehicle having an annular shaped frame supported on a pair of wheels at a front and rear end portion of said frame, a seat section supported above and connected to said frame, said safety brake comprising a support rod pivotally secured at opposed connecting ends thereof to said frame adjacent at least one pair of said wheels, said support rod defining a vehicle support section and a bridge section between said support section and said connecting ends; said support rod being displaceable from a disengaged position, where said vehicle is freely displaceably on said wheels on a surface, to an engaged position where said support section rests on said surface with at least some of said wheels lifted above said surface whereby to arrest said vehicle, said frame when in said disengaged position being disposed in close proximity to an associated one of said front and rear portion of said frame and permitting unobstructed displacement of the legs of an infant seated on said seat section and extending into an inner area of said annular shaped frame.

2. A safety brake as claimed in claim 1 wherein said vehicle support section is a large U-shaped section of said support rod constituted by a straight rod section and opposed straight side sections disposed in a common plane, said bridge section being angulated between said side sections and said connecting ends.

3. A safety brake as claimed in claim 2 wherein said support rod also integrally defines a small inverted U-shaped section at the free end of said opposed side sections, said opposed connecting ends and bridge section being integrally formed in an outer side arm of said small inverted U-shaped section.

4. A safety brake as claimed in claim 3 wherein said small inverted U-shape section is disposed adjacent a respective one of said at least one pair of wheels with said large U-shaped section extending forwardly thereof under said frame when said support section rests on said surface.

5. A safety brake as claimed in claim 1 wherein said frame is a substantially rectangular frame, a structural bar secured under each side arm of said frame and extending substantially parallel to one another, said safety brake being pivotally secured to said structural bar and extending transversely therebetween adjacent at least a pair of said wheels.

6. A safety brake as claimed in claim 5 wherein there are two safety brakes, each safety brake being pivotally secured across said structural bars adjacent each pair of said wheels.

7. A safety brake as claimed in claim 6 wherein there is further provided retention means to retain said safety brakes in said disengaged position.

8. A safety brake as claimed in claim 7 wherein said frame is a rectangular frame of plastics material, said structural bar being a metal bar secured under said side arms of said plastic frame, said retention means being constituted by frictional engagement of said connecting ends of said safety brake with said structural bars.

* * * * *